US005666700A

United States Patent [19]

Anscher et al.

[11] Patent Number: 5,666,700

[45] Date of Patent: Sep. 16, 1997

[54] LOCKABLE STRAP SEPARATOR FOR USE WITH BICYCLE HELMETS AND THE LIKE

[75] Inventors: Joseph Anscher, Muttontown, N.Y.; Gary Fraze, Alta Loma, Calif.

[73] Assignee: National Molding Corporation, Farmingdale, N.Y.

[21] Appl. No.: 501,594

[22] Filed: Jul. 12, 1995

[51] Int. Cl.[6] ..... A44B 11/25

[52] U.S. Cl. ..... 24/163 R; 2/421; 411/553; 24/135 R; 24/168

[58] Field of Search ..... 2/421; 24/585, 24/590, 591, 518, 324, 135 N, 135 R, 163 R, 168; 411/551, 552, 553, 554

[56] References Cited

U.S. PATENT DOCUMENTS

| | | | |
|---|---|---|---|
| 1,775,042 | 9/1930 | Lemoine | 24/591 |
| 2,260,048 | 10/1941 | Newell | 411/552 |
| 3,608,158 | 9/1971 | Bengtsson | 24/170 |
| 4,067,090 | 1/1978 | Schenk | 411/554 |
| 4,233,713 | 11/1980 | Berg | 24/191 |
| 4,486,918 | 12/1984 | Peebles | 24/590 X |
| 4,800,629 | 1/1989 | Ikeda | 24/170 |
| 4,991,271 | 2/1991 | Bauer et al. | 24/590 |
| 5,123,795 | 6/1992 | Engel et al. | 411/553 X |
| 5,142,834 | 9/1992 | Laclave et al. | 411/553 X |
| 5,172,455 | 12/1992 | Johnson et al. | 24/170 |
| 5,291,638 | 3/1994 | Huang | 24/170 |
| 5,368,427 | 11/1994 | Pfaffinger | 411/553 |
| 5,469,583 | 11/1995 | Akeley et al. | 24/170 X |
| 5,471,715 | 12/1995 | Knize | 411/553 X |
| 5,471,716 | 12/1995 | Takahashi | 24/590 X |

FOREIGN PATENT DOCUMENTS

| | | | |
|---|---|---|---|
| 0 643 933 A2 | 3/1995 | European Pat. Off. | A44B 11/12 |

*Primary Examiner*—Peter M. Cuomo
*Assistant Examiner*—Stephen Vu
*Attorney, Agent, or Firm*—Kenyon & Kenyon

[57] ABSTRACT

A strap divider for diverging a pair of straps which are disposed one on top of the other into a Y configuration which may be used for the chin straps of a bicycle helmet. The strap divider includes a main body which receives the pair of straps therethrough, and a rotatable clamping member which can be rotated from a position where the straps are clamped in place to an open position where the straps may be adjusted. In one embodiment, the rotatable member includes a cam around its circumference which cooperates with a projection in the main body for adjusting the clamping member between the open position and the locked position as the clamping member is rotated.

17 Claims, 5 Drawing Sheets

FIG.3
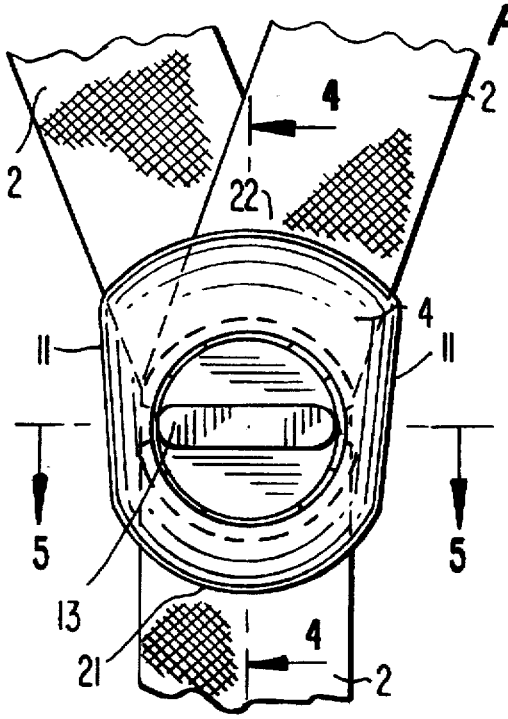
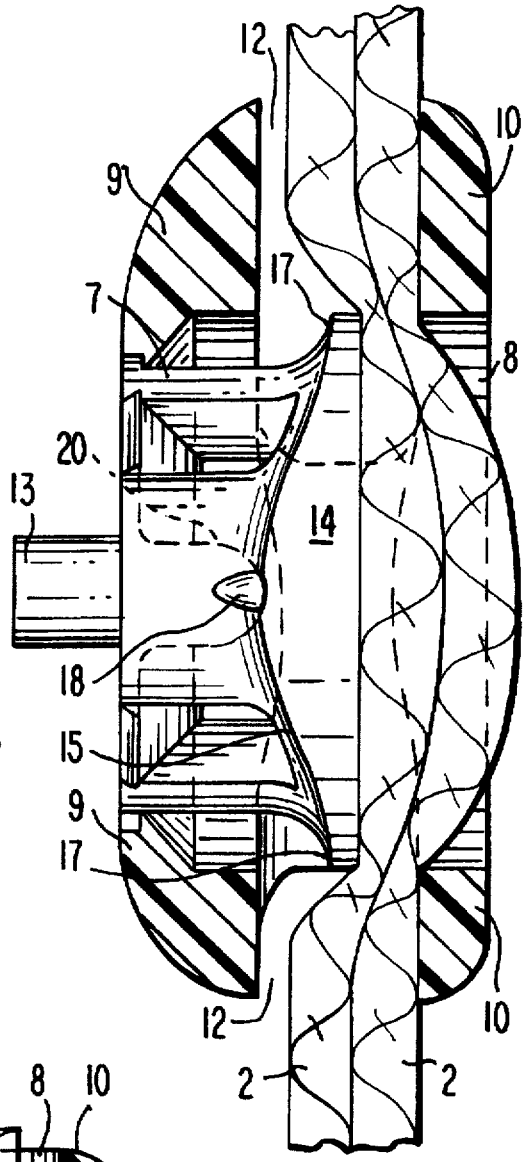
FIG.4
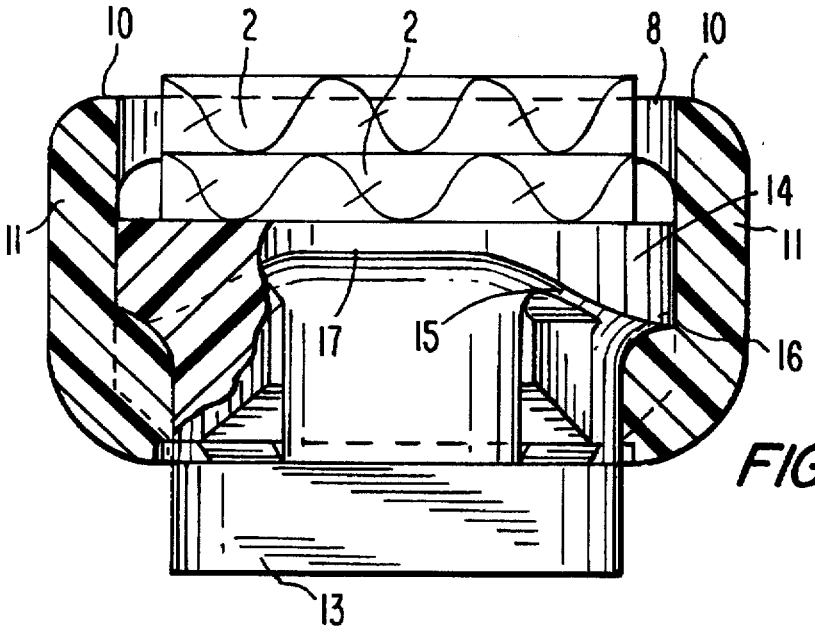
FIG.5

FIG.6
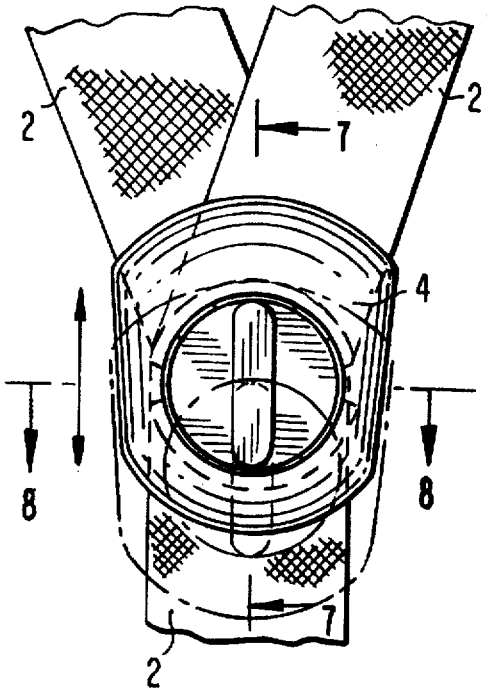
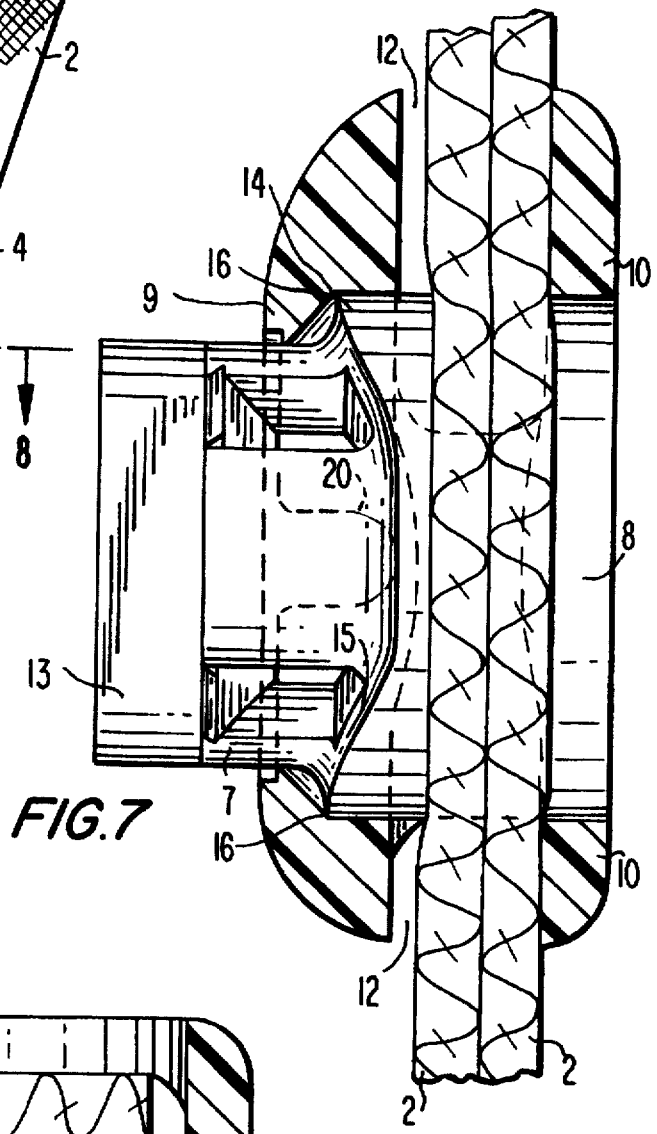
FIG.7
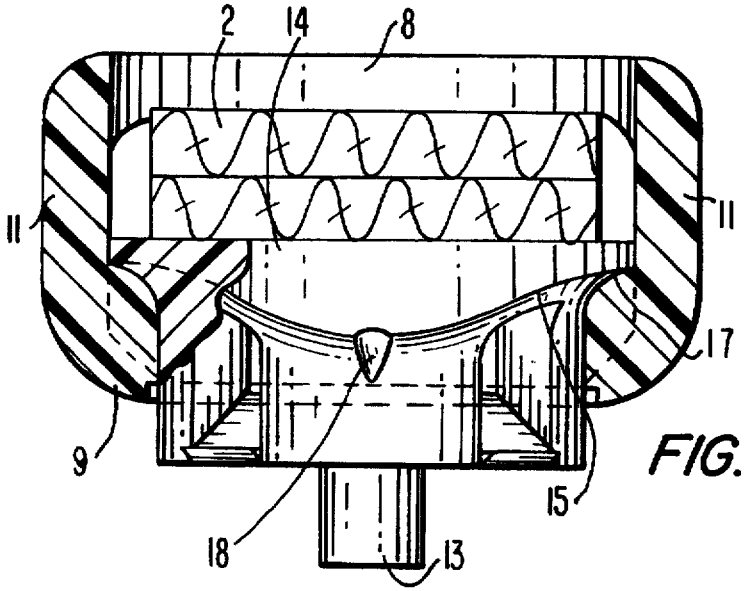
FIG.8

FIG.11
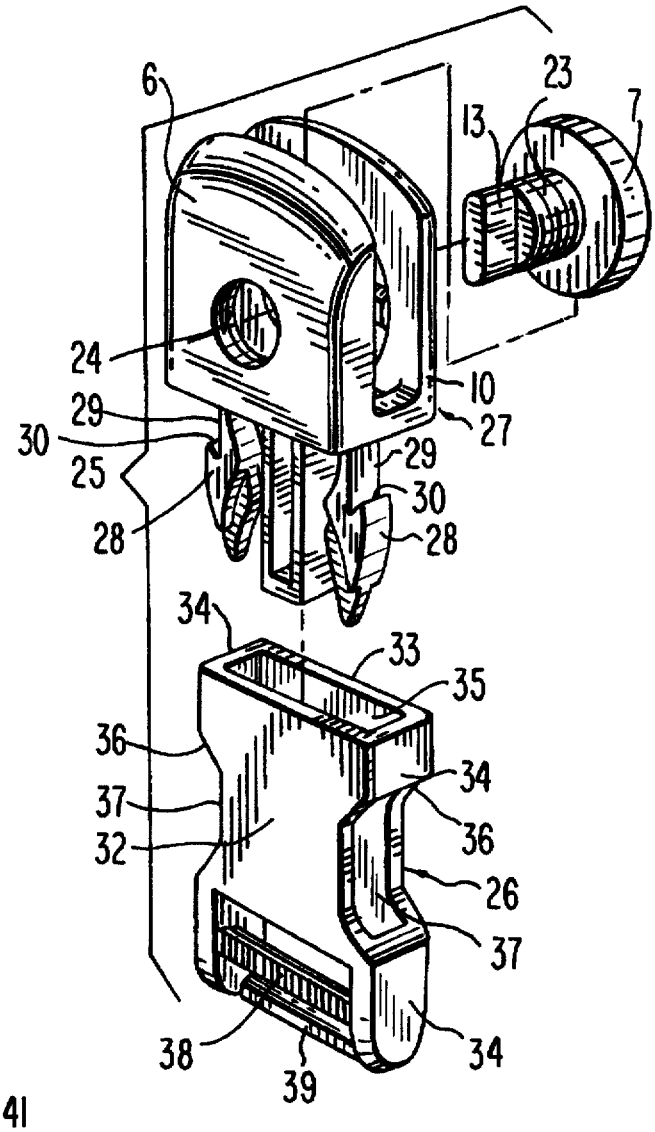
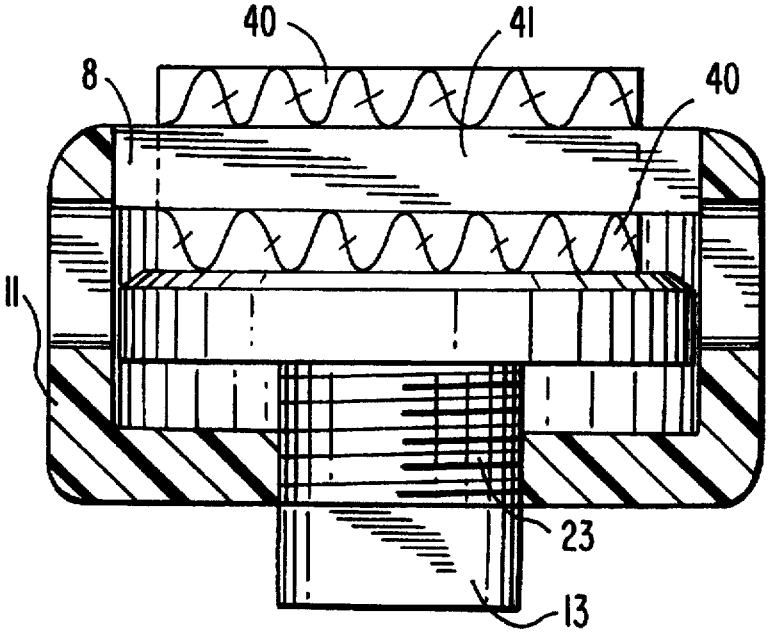
FIG.12

LOCKABLE STRAP SEPARATOR FOR USE WITH BICYCLE HELMETS AND THE LIKE

BACKGROUND OF THE INVENTION

1. Field of the Invention

The invention relates to a strap separator or divider which separates a pair of straps disposed one on top of the other into divergent directions. More particularly, the invention relates to such a strap separator which is lockable to fix the straps in a desired position, and which can be used for the chin straps of a bicycle helmet.

2. Description of Related Art

The use of bicycle helmets is becoming increasingly popular as a safety measure among both professional and amateur bicycle riders. Such helmets are typically provided with chin straps for securing the helmet to the wearer. The chin straps are joined by a two-piece buckle to permit the user to conveniently take the helmet off and put it back on.

Bicycle helmets are often provided with a pair of chin straps which are arranged one on top of the other in the region where they engage the wearer's chin, but which are separated along divergent paths in the direction towards their point of attachment to the bicycle helmet to define a Y configuration. The pair of chin straps define a Y configuration on opposite sides of the helmet. This configuration allows for greater stability of the chin strap-helmet combination. The chin straps are separated or divided along divergent paths by the two-piece buckle on one side of the helmet and by a strap separator or divider on the other side of the helmet.

Known strap dividers are typically adjustable (i.e., they can be moved along the length of the chin straps), however, they are not lockable (i.e., they cannot be securely fixed in a single position along the chin straps). It would be desirable for a bicycle helmet to be provided with a strap divider which is both adjustable and lockable to accommodate different size wearers of the bicycle helmet.

SUMMARY OF THE INVENTION

An object of the invention is to provide a strap separator for diverging a pair of straps into a Y configuration which is adjustable along the length of the straps and which can be locked in a fixed position relative to the straps. A further object of the invention is to provide such a strap separator for use with the chin straps secured to a bicycle helmet.

These and other objects of the invention are achieved by a strap separator which includes a rotatable inner plunger member which can be rotated to a position in which it pinches the straps threaded through the strap separator to hold the straps in a fixed position under tension. The main body of the strap separator includes a top surface and a bottom surface separated by a gap therebetween, the gap being adapted to tightly receive a pair of straps therethrough. The rear of the main body defines an open receiving end which extends into the gap, and the front of the main body defines an open exit end which is also continuous with the gap. The width of the main body from side to side increases in the direction from the receiving end to the exit end so that a pair of straps, arranged one on top of the other, threaded through the receiving end may be diverged from the exit end to define a Y configuration.

At least the top side of the main body defines an aperture therethrough for receiving the rotatable plunger member. The inner surface of the main body of the strap separator includes a pair of projections spaced 180° apart around the circumference of the aperture.

The inner rotatable member is a cylindrical member having a handle projecting from a top side thereof. The bottom section of the cylindrical member defines a cam like member around the periphery of the cylinder. The cam defines a ramped surface which engages the inner surface projections of the main body of the strap separator as the inner member is rotated about its central axis within the aperture of the main body. The ramped surface of the cam includes a pair of peaks spaced 180° apart around the periphery of the inner cylindrical member and a pair of valleys spaced 180° apart from each other around the periphery. The valleys separate the peaks, so that the ramped surface goes from valley to peak to valley to peak around the periphery of the inner cylindrical member.

As the inner cylindrical member is rotated within the aperture of the main body of the strap separator, the ramped surface of the cam will ride along the inward projections of the inner surface of the main body, causing the inner cylindrical member to be forced up and down. As the peaks of the ramped surface engage the projections, the inner cylindrical member will be forced down further into the gap in the main body of the strap divider, causing the straps threaded through the main body to be forced against the bottom side of the main body. The dimensions of the various parts of the strap separator are set so that, in this position, the straps will be squeezed between an engaging surface on the bottom side of the main body and the bottom side of the inner cylindrical member, so that the strap separator will remain in a fixed position with respect to the straps. Preferably, each peak of the ramped surface defines a dimple which is adapted to engage a projection to retain the strap separator in this locked position.

When the inner cylindrical member is rotated so that the projections ride down the valleys of the ramped surface of the cam, the inner cylindrical member will no longer be forced to compress the straps. In this position, the strap separator may be adjusted to a new location along the length of the straps.

BRIEF DESCRIPTION OF THE DRAWINGS

FIG. 3 is a top planar view of the strap separator shown in the locked position separating a pair of straps into a Y configuration.

FIG. 4 is a cross-sectional view of the strap separator illustrated in FIG. 3, taken along the line 4—4.

FIG. 5 is an inverted cross-sectional view of the strap separator illustrated in FIG. 3, taken along the line 5—5.

FIG. 6 is a top planar view of the strap separator in accordance with the invention in the unlocked, adjustable position, showing in phantom a second position of the strap separator along the length of the straps.

FIG. 7 is a cross-sectional view of the strap separator illustrated in FIG. 6, taken along the line 7—7.

FIG. 8 is an inverted cross-sectional view of the strap separator illustrated in FIG. 6, taken along the line 8—8.

FIG. 11 is an exploded view of the buckle illustrated in FIG. 9.

FIG. 12 is an inverted cross-sectional view of the buckle illustrated in FIG. 9, taken along the line 12—12.

DETAILED DESCRIPTION OF THE INVENTION

Figure 1:
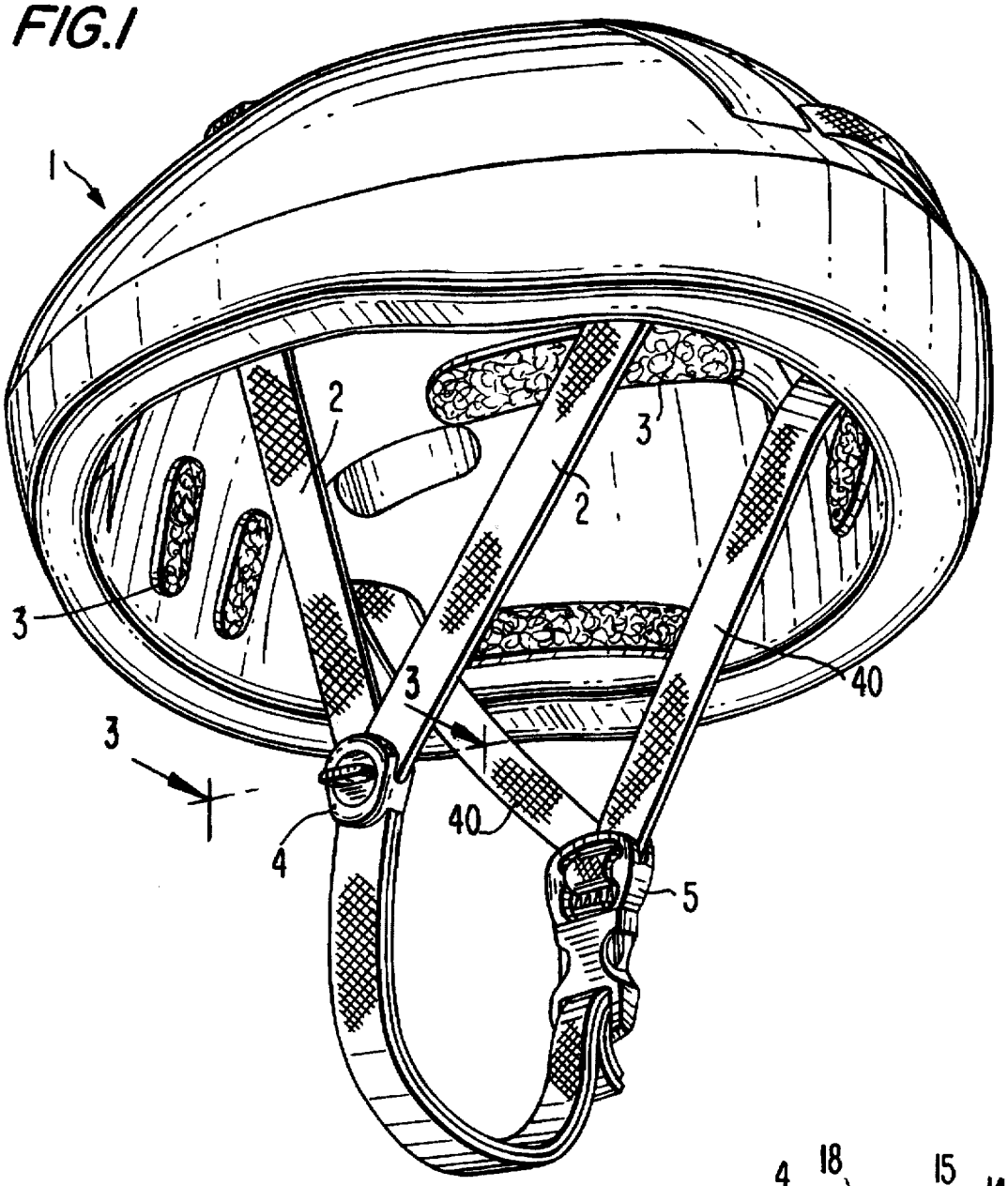
FIG. 1 is a perspective view of a bicycle helmet which includes the strap separator of the invention shown separating (diverging) a pair of chin straps into a Y configuration.

A bicycle helmet which incorporates the strap separator of the invention is generally illustrated in FIG. 1 at 1. The helmet 1 includes a pair of chin straps 2 for coupling the helmet to the wearer. The interior of the helmet 23 is provided with cushioning or padding 3 for a comfortable fit. As illustrated in FIG. 1, the chin straps 2 are separated (i.e., diverged) to define a Y configuration for improved stability. This is accomplished on one side of the helmet by the strap separator 4 of the invention, and on the other side of the helmet by a conventional two-piece side release buckle 5 which bends a strap 40 attached to the bicycle helmet to define a V configuration. Such side release buckles are well known in the art, and are commercially available from National Molding Corp. under the trade name DIVIDE AND CONQUER™. The two-piece side-release buckle 5 may be decoupled to open the chin straps 2 and strap 40 to facilitate the putting on and taking off of the helmet. The construction and operation of the side-release buckle 5 is well known and is not the subject of the present invention, therefore, no further discussion will be presented here except to say that one pair of the chin straps 2 is coupled to one piece of the buckle (e.g., the female member) and the strap 40 is coupled to the other piece of the buckle (e.g., the male member) in the V configuration. For a detailed discussion of the structure and operation of side-release buckles in general, see U.S. Pat. No. 4,150,464.

Figure 2:
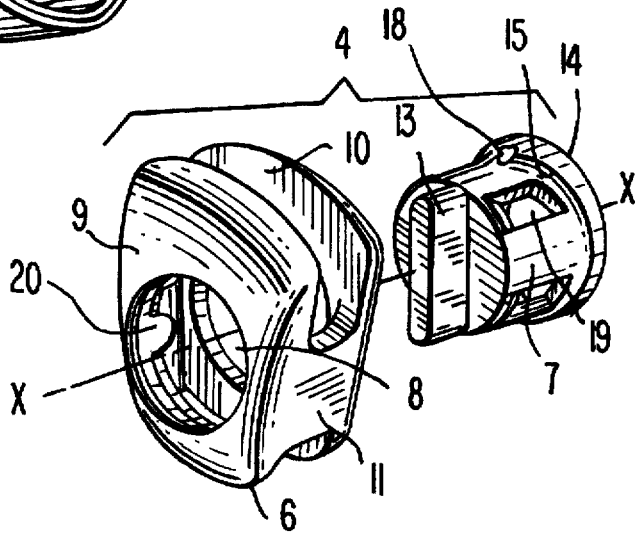
FIG. 2 is an exploded view of a strap separator in accordance with the invention.

An exploded view of the strap separator of the invention is illustrated in FIG. 2. The separator 4 includes a main body 6 and a rotatable cylindrical plunger member 7. Main body 6 defines an aperture 8, extending through a top wall 9 and a bottom wall 10 of the main body 6. The top wall 9 and bottom wall 10 are joined by side walls 11. The top wall 9 and the bottom wall 10 have a gap therebetween 12, which permits the pair of straps 2 to be threaded through the strap separator 4 (see FIGS. 4 and 7).

The rotatable plunger member 7 sits in the aperture 8 through the top wall 9 of the main body 6. The top of the plunger member 7 includes an upwardly projecting handle 13 which permits the user to rotate the plunger member 7 within aperture 8 about central axis X (see axis in FIG. 2). The plunger member 7 can rotate about its central axis X 360°.

The section of the plunger member 7 which is situated in the interior of the main body 6 has a cam like member 14 which extends 360° about the periphery of the cylindrical plunger member 7. Cam 14 defines a ramped surface 15 which runs from peak to valley to peak to valley 360° around the periphery of the cylindrical plunger member 7. As illustrated in FIGS. 4, 5, 7 and 8, the two peaks 16 are spaced 180° apart from each other and the two valleys 17 are spaced 180° apart from each other, and each peak 16 is spaced 90° apart from each valley 17. Each peak 16 has a dimple 18 defined therein (see FIGS. 4 and 8). The plunger member 7 may be molded with openings 19 around its periphery above the cam 14 for the purpose of saving raw material (e.g., plastic).

As illustrated in FIG. 7, a pair of straps 2, disposed one on top of the other, is threaded into the gap 12 defined between the top wall 9 and the bottom wall 10 of the main body 6. The straps 2 are also threaded beneath the bottom of the plunger member 7. The dimensions of the main body 6 and the cylindrical plunger member 7 are adjusted so that the pair of straps 2 fit snuggly between the bottom wall 10 and the bottom of the plunger member 7, as illustrated in FIG. 7.

The inside surface of the main body 6 includes a pair of inwardly projecting members 20, which are spaced 180° apart around the aperture 8 and which are adapted to be received in the dimples 18 on the cam of the plunger member, when the strap separator is in the locked position.

As illustrated in FIG. 3, the width from side 11 to side 11 of the strap separator 4 preferably increases from the entrance end 21 to the exit end 22 of the main body 6. This configuration allows room for the straps 2 to be diverged at the exit end 22 to form the Y configuration as illustrated in FIG. 3.

The operation of the strap separator will now be described. As illustrated in FIG. 3, the strap separator 4 functions to diverge a pair of straps 2 which are disposed one on top of the other into two different directions to form the Y configuration. FIGS. 3–5 illustrate the strap separator in a locked position, and FIGS. 6–8 illustrate the strap separator in the open, adjustable position. Referring to FIG. 6, in the open position, the strap separator may be moved along the length of the straps 2 to the desired position, as illustrated in phantom. It will be appreciated that as the cylindrical plunger member is rotated within aperture 8 about its central axis, the projections 20 belonging to the main body inner surface will ride along the ramped surface 15 of the cam 14. In order to place the strap separator in the open, adjustable position, the cylindrical plunger member 7 is rotated using handle 13 until the valleys 17 of the cam come into alignment with the projections 20 of the main body, as illustrated in FIG. 7 (with the projections 20 illustrated in phantom). It can be seen that the projections 20 will be forced to ride along the ramped surface 15 as the cam 14 rotates because of the upward pressure which will be exerted by the straps 2 compressed between the bottom surface of the plunger member 7 and the bottom wall 10 of the main body 6. However, in the open, adjustable position illustrated in FIGS. 7 and 8, it is possible to move the strap separator 4 relative to the pair of straps 2.

In order to place a strap separator 4 in the locked position and thereby fix the straps 2 in position, the cylindrical plunger 7 member is rotated about its axis using handle 13 to place the dimples 18 on the peaks 16 of the cam member 14 in alignment with the projections 20, as illustrated in FIG. 4 (with the projections 20 illustrated in phantom). It can be seen that as the plunger member 7 is rotated to this position, it is forced downward further into the main body 6, and that the straps 2 will be pinched between the outer periphery of the cam 14 on the plunger and the inner periphery of the aperture 8 defined in the bottom wall 10 of the main body 6. For this purpose, the diameter of the aperture 8 in the bottom wall 10 is just slightly larger than the diameter of the cam member around the bottom of the cylindrical plunger member 7. This has the effect of clamping the straps 2 in a fixed position. As illustrated in FIG. 4 and FIG. 5 (inverted cross-sectional view), in this position the straps 2 will actually bulge out from the aperture 8 in the bottom wall 10.

The engagement of the projections 20 with the dimples 18 serves to stabilize the plunger member in the locked position. However, the strap separator may be returned to the adjustable position merely by rotating the plunger member 7 90°, using handle 13, to once again place the projections 20 in alignment with the valleys 17 of the cam 14. As this is done, the compressed straps will force the plunger member 7 upward as the projections ride along the ramped surface 15.

In lieu of setting the diameters of the plunger member 7 and the aperture 8 as described above, the periphery of the bottom portion of the rotational plunger 7 or the perimeter of the aperture 8 in the bottom wall 10, or both, may be provided with teeth or serrations to grip the straps 2 in place. Of course, the teeth or serrations may also be provided in addition to providing for the different diameters, as discussed above.

The strap separator 4 is preferably molded out of plastic (e.g., polypropylene), but it can also be machined from metal. The strap separator may be molded or machined by methods well known in the art.

Figure 10:
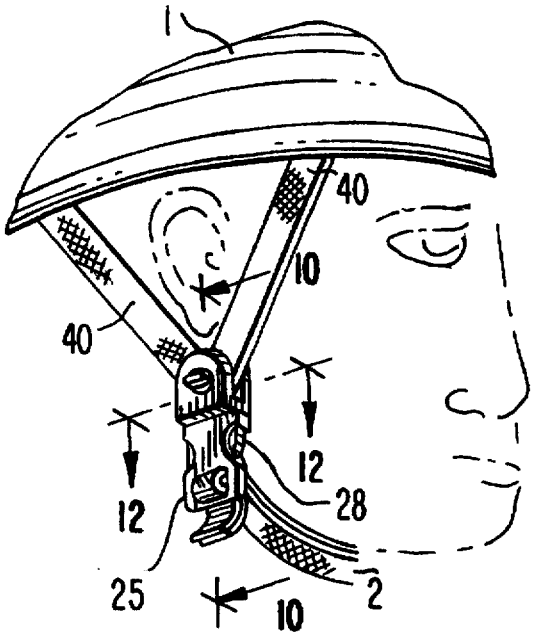
FIG. 10 is a cross-sectional view of the buckle illustrated in FIG. 9, taken along the line 10—10.

In a second embodiment of the invention, the camlike member 14 is replaced with a helical thread or threads 23 which extend 360° about the circumference of at least a portion of the cylindrical plunger member 7. In addition, the pair of inwardly projecting members 20 on the inside surface of the main body 6 are replaced by a thread or threads 24. In all other respects, the strap separator of this second embodiment of the invention is the same as the first embodiment described above. The threads and other distinctive features of this embodiment of the invention are illustrated in FIGS. 10–12 which shall be referred to hereinafter in connection with a third embodiment of the invention.

The threads 24 are adapted to mate with the threads 23 as the cylindrical plunger member 7 is rotated about its axis within the aperture 8 in the main body 6. As the plunger member 7 is rotated clockwise about its axis, its threads 23 will engage the mating threads 24 in the main body, thereby forcing the plunger member 7 downward further into the main body 6. As in the previous embodiment, the straps 2 will be pinched between the outer periphery of the plunger member 7 and the inner periphery of the aperture 8 defined in the bottom wall 10 of the main body 6. As in the previous embodiment, this has the effect of clamping the straps 2 in a fixed position.

To place the strap separator in the adjustable position, the plunger member 7 is simply rotated counterclockwise about its axis using handle 13. The cooperation of the threads 23 and the threads 24 will now force the plunger member 7 upward, thereby releasing the clamping force on the straps 2.

Figure 9:
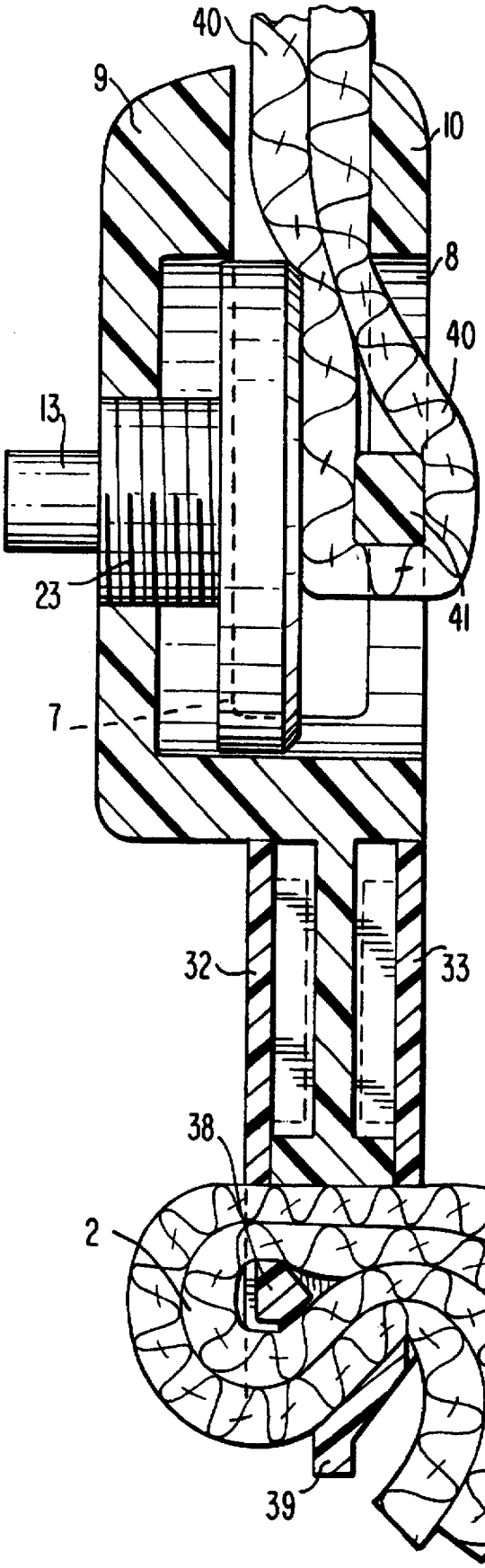
FIG. 9 is a perspective view of a two-piece, side-release buckle which integrally incorporates a strap separator in accordance with the invention, the buckle being used to bend a strap of a bicycle helmet in a V configuration.

In a third embodiment of the invention, the strap separator 4 of the invention is integrally incorporated into either the male member or the female member of a two-piece, side-release buckle, such as the buckle 5 illustrated in FIG. 1. Referring to FIGS. 9 and 11, where like reference numerals designate corresponding or like parts of the prior embodiments of the invention, a two-piece side-release buckle which integrally incorporates the strap separator of the invention into the male member thereof is generally illustrated at 25. The basic structure of the two-piece, side-release buckle is well known in the art. Referring to the exploded view of FIG. 11, the buckle includes a female member 26 which is adapted to be coupled with a male member 27. The male member 27 includes a main body 6 from which a pair of legs 29 project in the distal direction. As known in the art, the outer sides of the legs 29 are formed with a bulbous region 28. Each bulbous region 28 defines a shoulder 30 whose function will be explained hereinafter. The legs 29 are resiliently flexible to permit them to be forced inward, as will be described below.

Still referring to FIG. 11, the female member 26 includes a top wall 32, a bottom wall 33 and a pair of side walls 34 connecting the top and bottom walls. The walls 32, 33 and 34 define a cavity or socket therebetween. The female member 26 has an opening 35 in its distal end which is adapted to receive the legs of the male member. As known in the art, each of the side walls 34 of the female member projects inward toward the cavity to define a stop surface 36 which is adapted to engage a shoulder 30 defined in a leg of the male member, as will be explained below. Each side wall also defines an opening 37 adjacent to the stop surface 36 through which the bulbous region 28 of each leg of the male member will project when the male and female members of the buckle are coupled.

The female member 26 defines an upper crossbar 38 and a lower crossbar 39 at its proximal end. In a manner known in the art, a strap or straps 2 (e.g., the chin strap of a bicycle helmet) may be threaded around and between these crossbars (see FIG. 10). This strap or straps 2 may be adjusted with respect to the female member by pulling the strap from its free end while simultaneously angling the female member so that the strap is free to slide between the crossbars. Once the strap is adjusted to the desired point, the female member is returned to its ordinary orientation where the strap or straps is held between the crossbars in a fixed position. The adjustment of a strap or straps between a pair of crossbars in this manner is known and is described in detail in my U.S. Pat. No. 5,216,786 which is incorporated herein by reference.

In accordance with this embodiment of the invention, the main body of the male member 27 is configured as a strap separator. The legs 29 of the male member may be an extension of the side walls 11 of the main body 6 of the strap separator. The structure and operation of the strap separator is the same as any of the embodiments described above. In FIGS. 9–12, the buckle is illustrated with the second embodiment of the strap separator having the threaded members 23, 24 rather than the cam like member 14. However, the first embodiment which employs the cam may be integrally incorporated into the buckle in lieu of the second embodiment.

A strap 40 is diverged (or converged, depending upon which way it is looked at) into a V configuration (as illustrated in FIG. 9) by the main body 6 of the strap separator of the male member. For this purpose the male member 27 includes a crossbar 41 defined in its bottom wall 10. Strap 40 is looped around crossbar 41 and then diverged to define the V configuration, with the free ends of the strap 40 attached to the bicycle helmet as seen in FIG. 9. The strap 40 is clamped in place by the operation of the plunger member 7 as described above.

To couple the V configured strap 40 which is attached to the bicycle helmet to the Y configured straps 2 which are coupled to the female member of the buckle and the other side of the helmet (e.g., the chin straps of the helmet) the male member 27 of the buckle is coupled to the female member 26 of the buckle. The legs 29 of the male member are inserted into the cavity or socket defined in the female member through opening 35. As the bulbous region 28 of each leg is forced over the inwardly projecting side walls of the female member, the legs will flex inwardly. However, as soon as the bulbous region of each leg clears the stop surface 36 of each inwardly projecting side wall, the legs will be free to snap back outward with the bulbous regions 28 projecting through the openings 37 in the side walls 34 of the female member. In this locked or coupled position, the shoulder 30 defined in each leg of the male member will engage the stop surface 36 of the inwardly projecting part of the side wall of the female member.

As known in the art, to decouple the two-piece buckle 25, the user squeezes the bulbous regions 28 of the legs 29 of the male member 27 through the openings 37 in the side walls of the female member until the shoulders 30 in the legs clear the stop surfaces 36 of the inwardly projecting side walls, whereupon the male and female members may be separated. The force which will now be exerted by the flexed, resilient legs 29 will urge the male member to spring out of the cavity in the female member. Separation of the two buckle pieces will also be facilitated by the arcuate shape of bulbous region on the legs (see FIG. 11).

As known in the art, two-piece buckles of this general type (for example, the National Molding DIVIDE AND CONQUER™) permit a bicycle helmet user to readily put on and remove the helmet. In addition, these buckles enable the user to adjust the chin straps 2, 40 of the helmet for a proper fit. However, the novel construction of the male member of the buckle in accordance with the present invention (i.e., the integral incorporation of a strap separator 4 of the invention as the main body of the male member) also affords a more reliable locking of the strap 40 which is diverged into the V configuration than has been possible in the prior art.

In the foregoing specification, the invention has been described with reference to specific exemplary embodiments thereof. It will, however, be evident that various modifications and changes may be made thereunto without departing from the broader spirit and scope of the invention as set forth in the appended claims. For example, the aperture 8 in the bottom wall 10 may be filled in, and the inner surface of the bottom wall 10 may be roughened to grasp the strap in place as it is forced against the roughened surface by the plunger 7. The specification and drawings are accordingly to be regarded in an illustrative rather than a restrictive sense.

What is claimed is:

1. An apparatus for clamping a pair of straps, comprising:

a main body defining a passageway between-an-open entrance and an open exit end of the main body for receiving a pair of straps therethrough, the main body defining an aperture therein; and a clamping member which is rotatable within said aperture between a first position in which it is adapted to clamp a pair of straps between a bottom surface or a peripheral side surface of the clamping member and the main body and a second position in which the clamping member is adapted to permit a pair of straps to be moved through said passageway, wherein the clamping member is a cylindrical member having a cam around it, the cam having a ramped surface extending between at least one peak and at least one valley of the cam, and wherein the main body has an interior surface having a projection which engages the ramped surface of the cam, wherein the projection engages the peak of the cam in said first position and wherein the projection engages the valley of the cam in said second position.

2. The apparatus according to claim 1, wherein the main body includes a top wall and a bottom wall, the top wall defining the aperture which receives the rotatable clamping member and the bottom wall defining a second aperture, wherein in said first position the clamping member is adapted to clamp a pair of straps between the perimeter of the second aperture and the clamping member.

3. The apparatus according to claim 2, wherein the perimeter of the second aperture has a serrated edge for engaging strap in said first position of the clamping member.

4. The apparatus according to claim 1, wherein the ramped surface of the cam defines a dimple at the dam peak, and wherein the dimple receives the projection of the main body in said first position of the clamping member.

5. The apparatus according to claim 2, wherein the ramped surface of the cam defines a dimple at the cam peak, and wherein the dimple receives the projection of the main body in said first position of the clamping member.

6. The apparatus according to claim 2, wherein the cam has a pair of peaks spaced 180° apart around the periphery of the cylindrical clamping member and a pair of valleys, each valley spaced 90° apart from each peak around the periphery of the cylindrical clamping member, and wherein the main body has a pair of projections spaced 180° apart around the aperture which receives the cylindrical clamping member.

7. The apparatus according to claim 2, wherein the main body has a pair of opposing side walls joining the top wall and the bottom wall, and wherein the width of the main body as measured between said opposing side walls increases in the direction from said open entrance end to said open exit end.

8. The apparatus according to claim 1, wherein the clamping member has a serrated edge for engaging a strap in the first position.

9. The apparatus according to claim 1, wherein the cam has a pair of peaks spaced 180° apart around the periphery of the cylindrical clamping member and a hair of valleys, each valley spaced 90° apart from each peak around the periphery of the cylindrical clamping member, and wherein the main body has a pair of projections spaced 180° apart around the aperture which receives the cylindrical clamping member.

10. The apparatus according to claim 1, wherein the cylindrical clamping member includes a handle which extends outside of the main body.

11. The apparatus according to claim 1, wherein the main body has a pair of opposing side walls, and wherein the width of the main body as measured between said opposing side walls increases in the direction from said open entrance end to said open exit end.

12. The apparatus according to claim 1, wherein the main body has a pair of opposing side walls, and wherein the width of the main body as measured between said opposing side walls increases in the direction from said open entrance end to said open exit end.

13. An apparatus in combination with a pair of straps, comprising:

a main body defining a passageway between an open entrance end and an open exit end of the main body, the main body comprising a top wall defining an aperture therein, a bottom wall and a pair of side walls joining the top wall to the bottom wall, wherein the width of the main body as measured between said side walls increases in the direction from said entrance end to said exit end;

a pair of straps disposed and aligned one on top of the other which are received through said open entrance end, the straps diverging away from each other out from said open exit end of the main body; and a clamping member which is rotatable within said aperture in the top wall between a first position in which clamps said pair of straps between the member and the main body and a second position wherein said straps may be moved through said passageway.

14. The apparatus according to claim 13, wherein the bottom wall defines a second aperture, and wherein in said first position of the clamping member the straps are clamped between the perimeter of the second aperture and the clamping member.

15. The apparatus according to claim 13, wherein the clamping member is a cylindrical member having a cam around it, the cam having a ramped surface extending between at least one peak and at least one valley of the cam, and wherein the main body has an interior surface having a projection which engages the ramped surface of the cam, wherein the projection engages the peak of the cam in said first position and wherein the projection engages the valley of the cam in said second position.

16. The apparatus according to claim 15, wherein the cam has a pair of peaks spaced 180° apart around the periphery of the cylindrical clamping member and a pair of valleys, each valley spaced 90° apart from each peak around the periphery of the cylindrical clamping member, and wherein the main body has a pair of projections spaced 180° apart around the aperture which receives the cylindrical clamping member.

17. An apparatus for clamping a pair of straps, comprising:

a main body defining a passageway between an open entrance and an open exit end of the main body for receiving a pair of straps therethrough, the main body including a top wall and a bottom wall, the top wall defining a first aperture therein and the bottom wall defining a second aperture therein, the second aperture having a perimeter with a serrated edge; and a clamping member which is rotatable within said first aperture between a first position in which it is adapted to clamp a pair of straps between a bottom surface or a peripheral side surface of the clamping member and the serrated edge of the second aperture and a second position in which the clamping member is adapted to permit a pair of straps to be moved through said passageway.

* * * * *